US007824508B2

(12) United States Patent
Teramoto et al.

(10) Patent No.: US 7,824,508 B2
(45) Date of Patent: Nov. 2, 2010

(54) FINE GRAIN SURFACE LAYER STEEL PART AND METHOD OF PRODUCTION OF SAME

(75) Inventors: Shinya Teramoto, Tokyo (JP); Hiromasa Takada, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 426 days.

(21) Appl. No.: 11/990,793

(22) PCT Filed: Jul. 27, 2007

(86) PCT No.: PCT/JP2007/065218

§ 371 (c)(1),
(2), (4) Date: Feb. 20, 2008

(87) PCT Pub. No.: WO2008/013323

PCT Pub. Date: Jan. 31, 2008

(65) Prior Publication Data

US 2009/0095383 A1 Apr. 16, 2009

(30) Foreign Application Priority Data

Jul. 28, 2006 (JP) ..... 2006-206092

(51) Int. Cl.
*C22C 38/12* (2006.01)
*C22C 38/02* (2006.01)
*C22C 38/04* (2006.01)

(52) U.S. Cl. ..... 148/320; 148/649; 148/653; 148/654; 148/643; 148/644; 148/665; 148/902

(58) Field of Classification Search ..... 148/320, 148/649, 653, 654, 643, 644, 665, 902
See application file for complete search history.

(56) References Cited

FOREIGN PATENT DOCUMENTS

| | | | |
|---|---|---|---|
| JP | 56-169723 | | 12/1981 |
| JP | 58-58224 | A | 4/1983 |
| JP | 10-195530 | | 7/1998 |
| JP | 11-315342 | A | 11/1999 |
| JP | 2000-160292 | A | 6/2000 |
| JP | 2003-147482 | | 5/2003 |
| JP | 2003-155521 | | 5/2003 |
| JP | 2004-137542 | | 5/2004 |
| JP | 2005-133155 | A | 5/2005 |

*Primary Examiner*—Deborah Yee
(74) *Attorney, Agent, or Firm*—Kenyon & Kenyon LLP

(57) ABSTRACT

The present invention provides a fine grain surface layer steel part having a high proof strength ratio equal to or higher than that of conventional quenched and tempered materials, that is, a fine grain surface layer steel part containing, by mass %, C: 0.45% to 0.70%, Nb: 0.01% to 0.60%, Si: 0.10% to 1.50%, Mn: 0.40% to 2.0%, P: 0.10% or less, S: 0.001% to 0.15%, and N: 0.003% to 0.025% and having a balance of Fe and unavoidable impurities, where the surface layer and inside at all or part of the part have structures of different average particle sizes of ferrite crystal grains surrounded by high angle grain boundaries of a misorientation angle of 15 degrees or more and a method of production of that part comprising warm forging locations where strength is required to a predetermined shape at 1000° C. to 800° C. during which working so as to give an equivalent strain of 1.5 or more.

5 Claims, 1 Drawing Sheet

FINE GRAIN SURFACE LAYER STEEL PART AND METHOD OF PRODUCTION OF SAME

TECHNICAL FIELD

The present invention relates to a forged part for a machine structure and a method of production of the same, more particularly relates to a fine grain surface layer steel part where the surface layer of locations where strength is required is made finer grained by warm forging and heat treatment and where the strength difference between the surface layer and inside is made larger so as to provide both a high strength and high proof strength ratio and machineability and to a method of production of such a part.

BACKGROUND ART

Conventional steel hot forged parts were given high strength and high toughness by hot forging a steel bar into the shape of the part, then reheating it and patenting it by quenching and tempering. However, the ratio of the patenting costs in the production costs of the part was large, so hot forged non-patented steel eliminating the quenching and tempering patenting has been developed.

In the past, hot forged parts using non-patented steel were produced by heating once to 1200° C. or more and forging at a high temperature of 1000 to 1200° C. or so. However, heating at 1200° C. or more causes the austenite grains to coarsen, while forging at a high temperature of 1000 to 1200° C. or so causes recrystallization after working and results in a coarser structure obtained in the cooling process. Therefore, a hot forged part using non-patented steel, compared with a patented steel part, generally has a smaller proof strength ratio and impact value and a smaller strength difference from the surface layer to the inside, so the machinability dropped along with an increase in the part strength.

To solve these problems, Japanese Patent Publication (A) No. 56-169723 describes to control the suitable ingredient system and cooling rate after hot forging so as to disperse a large amount of in-grain ferrite having MnS cores and as a result make the structure substantially finer grained and improve the fatigue characteristics. However, the structure obtained by this method is still coarse. The amount of increase of strength due to the finer structure is small.

Japanese Patent Publication (A) No. 10-195530 proposes forging by a temperature lower than the conventional forging temperature, that is, by 800 to 1050° C., obtaining a fine ferrite-pearlite structure in the cooling process, and producing a non-patented steel forged part having a higher strength and higher toughness by making the structure finer. However, the crystal granularity of the ferrite obtained by this method is the #10 to #12 or so. The increase in strength due to the finer structure is small.

Japanese Patent Publication (A) No. 2003-147482 further proposes the method of forging by a low temperature of 700 to 800° C., obtaining a ferrite-pearlite structure having an average crystal grain size of the ferrite and pearlite of 10 μm or less by the cooling process, and improving the strength and toughness by the finer structure. However, this method has a forging temperature of a low temperature of 700 to 800° C., so the deformation resistance remarkably increases over conventional forging and the load on the forging machine and tooling becomes greater.

To counter this increase in the deformation resistance due to the reduction of the forging temperature, Japanese Patent Publication (A) No. 2003-155521 proposes a method of production of a high strength forged part characterized by performing a coarse working step of forging the steel to a coarse shape at 1100 to 1300° C., then performing a finishing step of forging the locations where a high strength is required to the final shape at 600 to 850° C. and making the structure transform to a ferrite-pearlite structure in the cooling process so as to make the locations where high strength is required 5 μm or less ferrite grains. However, the tensile strength is a low 600 to 750 MPa. Further, when forging in the practical forging temperature region of 800° C. or more, the yield ratio is 0.82 or less. This is far from quenched and tempered steel.

Furthermore, Japanese Patent Publication (A) No. 2004-137542 proposes a high strength and high yield ratio non-patented steel hot forged member obtained by forging by a forging temperature of a relatively high temperature of 1000 to 1200° C., then cooling to room temperature by a 0.5 to 5° C./sec cooling rate to transform the structure to a ferrite-pearlite structure and further cold working by a degree of processing of 2 to 10%. However, in this method, after forging, a cold working step is added. The manufacturing cost rises by that amount.

DISCLOSURE OF THE INVENTION

The present invention provides a fine grain surface layer steel part, provided with both a high proof strength ratio and machineability equal to or greater than those of conventional quenched and tempered materials, where locations where strength is required, in particular the surface layer, are strengthened by making those locations a fine grain structure having ferrite crystal grains of 4 μm or less and, further, making the strength difference between the surface layer and inside larger and a method of production of the same.

The inventors took note of the fact that by making the structure at locations where stress concentrates during use of a part finer, the substantive strength of the part is improved and that by making the strength difference between the surface layer and inside larger, the machineability is maintained and studied the optimum steel ingredients and heat treatment method for obtaining a structure comprised of ferrite having a ferrite crystal grain size of 4 μm or less and of pearlite and/or cementite in the relatively high temperature region of warm forging. As a result, they obtained the discoveries that:

(a) By adding to C: 0.45 to 0.70 mass % high carbon steel an amount of Nb greater than that of ordinary hot forging use steel, a composite effect of a pinning effect due to the Nb carbides and a solute drag effect due to the solid solution Nb is obtained and the composite effect prevents coarsening of the austenite crystal grains at the time of forging heating and at the time of reheating for reverse transformation, (b) Increasing the fineness of the austenite crystal grains due to the reverse transformation is effective, and (c) By immediately rapidly cooling the steel after forging, the recovery and recrystallization in the cooling process are suppressed and the fineness is increased after the transformation.

By combining these discoveries (a) to (c), the inventors discovered that a structure comprised of ferrite having a ferrite crystal grain size of 4 μm or less and of pearlite and/or cementite is obtained in the relatively high temperature region of warm forging, the increased fineness causes the proof strength to remarkably rise, and the proof strength ratio is improved. Further, they discovered that by making the structure of the inside a structure of ferrite having an average particle size of ferrite crystal grains surrounded by high angle grain boundaries of a misorientation angle of 15 degrees or more of 15 μm or more and of pearlite, the machineability can be maintained.

The present invention is a fine grain surface layer steel part and a method of production of this part completed based on these discoveries. The gist of the invention is as follows:

(1) A fine grain surface layer steel part containing, by mass %,

C: 0.45% to 0.70%,
Nb: 0.01% to 0.60%,
Si: 0.10% to 1.50%,
Mn: 0.40% to 2.0%,
P: 0.10% or less,
S: 0.001% to 0.15%,
N: 0.003% to 0.025% and having a balance of Fe and unavoidable impurities, said fine grain surface layer steel part characterized in that the surface layer and inside at all or part of the part have structures of different average particle sizes of ferrite crystal grains surrounded by grain boundaries of a large angle of a misorientation angle of 15 degrees or more, the structure from the surface to a depth of at least 1.0 mm is a structure comprised of ferrite having an average particle size of ferrite crystal grains surrounded by high angle grain boundaries of a misorientation angle of 15 degrees or more of 4 μm or less and of pearlite and/or cementite, while the structure of the location from the center of thickness of the part to at least ⅙ thickness is a structure comprised of ferrite having an average particle size of ferrite crystal grains surrounded by high angle grain boundaries of a misorientation angle of 15 degrees or more of 15 μm or more and of pearlite.

(2) A fine grain surface layer steel part as set forth in (1), characterized in that the ingredients of the steel further contain, by mass %, Al: 0.005 to 0.050%.

(3) A fine grain surface layer steel part as set forth in (1) or (2), characterized in that the ingredients of the steel further contain, by mass %, V: 0.01% to 0.50%.

(4) A method of production of a fine grain surface layer steel part characterized by heating a steel material comprised of the ingredients as set forth in any of (1) to (3) at 1150° C. to 1350° C., cooling locations where strength is required to 400° C. or less by an average cooling rate of 0.5° C./sec to 150° C./sec, raising the temperature after said cooling to 800 to 1000° C. by an average heating rate of 1.0° C./sec or more, and warm forging to a predetermined shape at 1000° C. to 800° C. during which working to give an equivalent strain of 1.5 to 5.0, cooling after that working to 550° C. to 650° C. in temperature range by an average cooling rate of 10° C./sec to 150° C./sec, then air cooling or thermostatically treating the entire part so as to make the structure from the surface to a depth of at least 1.0 mm at locations where strength is required a structure comprised of ferrite having an average particle size of ferrite crystal grains surrounded by high angle grain boundaries of a misorientation angle of 15 degrees or more of 4 μm or less and of pearlite and/or cementite and make the structure of the location from the center of thickness of the part to at least ⅙ thickness a structure comprised of ferrite having an average particle size of ferrite crystal grains surrounded by high angle grain boundaries of a misorientation angle of 15 degrees or more of 15 μm or more and of pearlite.

(5) A method of production of a fine grain surface layer steel part characterized by heating a steel material comprised of the ingredients as set forth in any of (1) to (3) at 1150° C. to 1350° C. and warm forging to a predetermined shape at 1000° C. to 800° C. during which working to give an equivalent strain of 1.5 to 5.0, cooling after that working to 400° C. or less by an average cooling rate of 0.5° C./sec to 150° C./sec, raising the temperature after said cooling to 800 to 1000° C. by an average heating rate 1.0° C./sec or more, then air cooling the entire part so as to make the structure from the surface to a depth of at least 1.0 mm at locations where strength is required a structure comprised of ferrite having an average particle size of ferrite crystal grains surrounded by high angle grain boundaries of a misorientation angle of 15 degrees or more of 4 μm or less and of pearlite and/or cementite and make the structure of the location from the center of thickness of the part to at least ⅙ thickness a structure comprised of ferrite having an average particle size of ferrite crystal grains surrounded by high angle grain boundaries of a misorientation angle of 15 degrees or more of 15 μm or more and of pearlite.

BEST MODE FOR CARRYING OUT THE INVENTION

Figure 1:
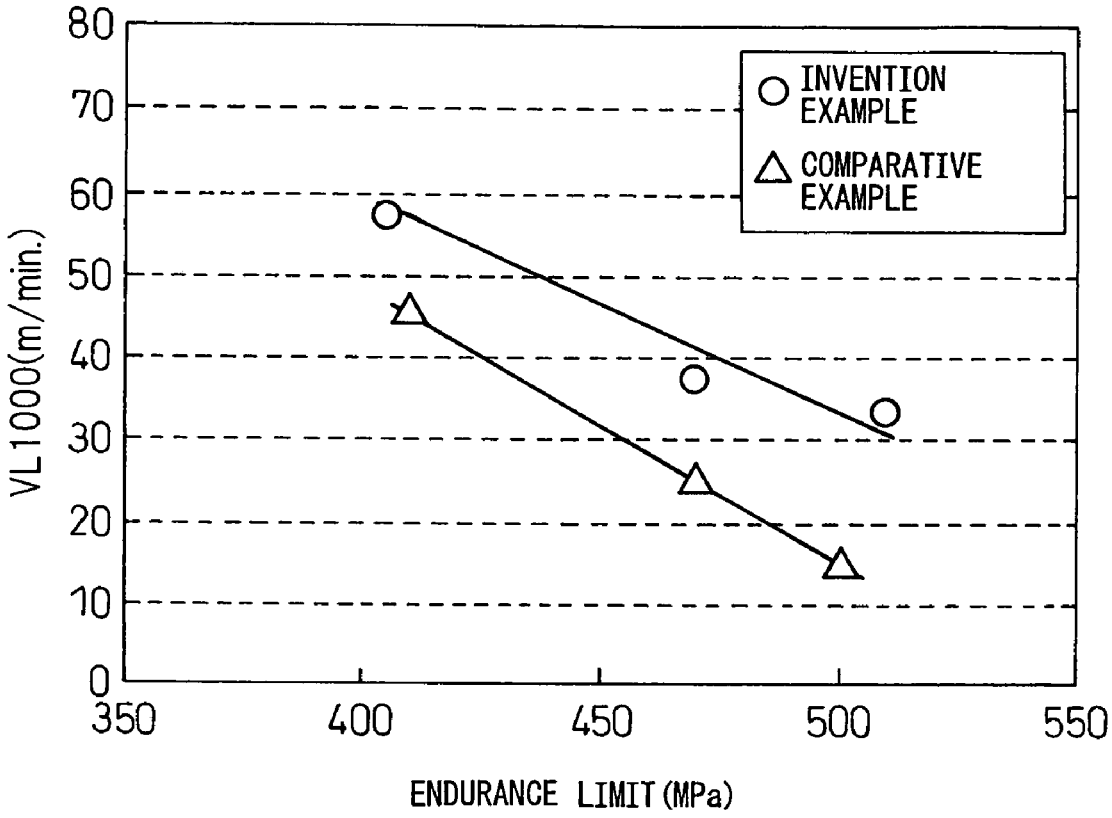
FIG. 1 is a view explaining the relationship between the endurance limit and machinability of the invention examples and comparative examples of Table 2-5.

First, the reasons for limitation of the alloy ingredients of the steels described in claims 1 to 3 will be explained below.

C: 0.45% to 0.70%

C is an element effective for securing the strength required as a part. To keep down the addition of alloying elements other than carbon and obtain sufficient strength as a part, the lower limit is made 0.45% or more. Preferably, it is made 0.50% or more. In the present invention, as the method of increasing the fineness, the methods of production of claims 4 to 5 were applied. However, if excessively added, the pearlite structure increases and the proof strength, impact value, and machinability fall, so the upper limit is limited to 0.70%. Further, C forms carbides with Nb and is effective for preventing coarsening of the austenite grains at the time of forging heating and at the time of reverse transformation.

Nb: 0.01% to 0.60%

Nb is present in solid solution and as carbides in the austenite at the time of heating. The solid solution Nb exhibits a solute drag effect of delaying the recovery of dislocations, recrystallization, and grain growth. Further, Nb carbides act as pinning grains stopping grain growth. In the present invention, a greater amount of Nb is added to C: 0.45 to 0.70% high carbon steel than with conventional hot forging use steel, whereby a composite effect of the above solute drag effect and pinning effect is obtained. This composite effect is effective against the prevention of coarsening of the austenite grains at the time of forging heating and the time of reverse transformation. To sufficiently obtain this composite effect, addition of 0.01% or more is necessary. However, if excessively added, the cost becomes high, so the upper limit is limited to 0.60%.

Si: 0.10% to 1.50%

Si is an element effective as a solution strengthening element of ferrite and an element promoting ferrite transformation and suppressing precipitation of bainite, but if less than 0.10%, these effects are small. However, if excessively added, the proof strength ratio, impact value, and machineability fall and, further, decarbonization occurs, so the upper limit is limited to 1.50%.

Mn: 0.40% to 2.0%

Mn has to be included in an amount of 0.40% or more to fix the S in the steel as sulfides and improve the hot ductility. However, if excessively added, the quenchability rises, the bainite precipitates in the rapid cooling process right after forging, and the toughness and machineability fall, so the upper limit is limited to 2.0%.

P: 0.10% or less

P precipitates at the grain boundaries and reduces the toughness, so is limited to 0.10% or less. The smaller the amount, the more preferable, but if considering the manufacturing costs, the lower limit is preferably made 0.001%.

S: 0.001% to 0.15%

S is an element forming MnS and improving the machineability, but if less than 0.001%, a sufficient effect cannot be obtained. However, the anisotropy of the mechanical properties becomes larger, so the upper limit is limited to 0.15%.

N: 0.003 to 0.025%

N has the effect of forming nitrides with various elements and of suppressing the coarsening of the austenite crystal grains at the time of forging heating and at the time of reverse transformation. To sufficiently obtain this effect, the lower limit is made 0.003%. However, if excessively added, the hot ductility falls and cracks and flaws easily occur, so the upper limit is made 0.025%.

Al: 0.005 to 0.050%

Al is an element effective for deoxidation. To obtain this effect, addition of 0.005% or more is necessary. However, if excessively added, it forms oxides and reduces all of the proof strength ratio, impact value, and machineability, so the upper limit is made 0.050%.

V: 0.01% to 0.50%

V forms carbonitrides and strengthens the ferrite by precipitation strengthening. Further, the solid solution V has the effect of delaying recovery of dislocations and the recrystallization phenomenon and prevents coarsening of the austenite crystal grains at the time of forging heating and at the time of reverse transformation. To sufficiently obtain this effect, 0.01% or more is necessary. However, when over 0.50%, the toughness falls and further detracts from the forgeability, so the upper limit was made 0.50%.

The reasons for limitation of the characteristics of the parts described in claims 1 to 3 will be explained below.

Next, when a forged part for a machine structure breaks during use, in general the cracks proceed and break from the surface at locations where the stress concentration coefficient is high. Accordingly, there is no need for making the part as a whole a high strength. By making only the surface where the stress concentrates a high strength, it is possible to sufficiently improve the performance of the part. To improve the performance of the part, it is necessary to increase the strength from the surface of the parts of the part where the stress concentrates or the entire part to a depth of at least 1.0 mm. However, if ending up making the entire cross-section of the part high in strength, the boring or other machineability falls, so it is necessary to make the strength, that is, the hardness, of the location from center of thickness of the part down to at least ⅙ thickness 30 HV or more lower than the surface layer.

The inventors analyzed steels by the ferrite crystal grains surrounded by high angle grain boundaries of a misorientation angle of 15 degrees or more and the proof strength, whereupon they confirmed that, as known by the Hall-Petch empirical rule, by making the ferrite crystal grains finer, the proof strength rises and that by making the grain size 4 μm or less, the amount of strengthening is large. A structure comprised of ferrite having a ferrite crystal grain size of 4 μm or less and pearlite and/or cementite has a high proof strength ratio equal to or greater than a conventional quenched and tempered material. Furthermore, if the average particle size of the ferrite crystal grain is made finer to 3 μm or less, the amount of strengthening becomes remarkably larger. For the above reasons, they made the structure from the surface to a depth of at least 1.0 mm at all or part of the part, that is, at locations of the part where strength is required, a structure comprised of ferrite having an average particle size of ferrite crystal grains surrounded by grain boundaries of a large angle of a misorientation angle of 15 degrees or more of 4 μm or less and of pearlite and/or cementite.

Further, if the average particle size of the ferrite crystal grains of the structure at locations from the center of thickness of the part to at least ⅙ thickness is less than 15 μm, the hardness of the inside cannot be reduced by 30 HV or more from the surface layer, so the inventors made the structure of these locations a structure comprised of ferrite having an average particle size of ferrite crystal grains surrounded by grain boundaries of a large angle of a misorientation angle of 15 degrees or more of 15 μm or more and of pearlite.

The average particle size of the ferrite crystal grain spoken of here was made the area weighted average circle equivalent diameter of the ferrite crystal grains surrounded by grain boundaries of a large angle of a misorientation angle of 15 degrees or more obtained by analysis of the crystal orientation from the back scattering electron beam diffraction pattern. The area weighted average circle equivalent diameter D is calculated from the results of analysis using the following formula (1):

$$D = \frac{\sum_{i=1}^{n} Ai \cdot di^2}{\sum_{i=1}^{n} Ai \cdot di} \tag{1}$$

where, di is the center value of the i-th stage when making the range of stages of the circle equivalent size of the ferrite crystal grains 0.5 μm. Ai is the frequency of presence of the ferrite crystal grains at the i-th stage.

Next, the reasons for limitation of the methods of production of the parts as set forth in claims 4 and 5 will be explained below.

First, the reasons for limiting claims 4 and 5 to heating the steels of claims 1 to 3 to 1150° C. to 1350° C. will be explained below. If the steels set forth in claims 1 to 3 are less than 1150° C., the amount of solid solution Nb and other solute atoms is small and the solute drag effect is insufficient, therefore the composite effect with the pinning effect due to the Nb carbides cannot be sufficiently obtained. On the other hand, if over 1350° C., the amount of Nb carbides decreases, the pinning effect is insufficient, and the composite effect with the solute drag effect due to the solid solution Nb or other solute atoms cannot be obtained. Further, the driving force behind crystal grain growth is large and the austenite grains coarsen at the time of forging heating.

There is no need to make the forged part for a machine structure high in strength in the part as a whole. By just making the surface layer at the locations where the stress concentration coefficient is high during use a high strength, the part is sufficiently improved in performance. For example, in a crankshaft, the pin part where the connecting rod is attached and, in a connecting rod, the part connecting the big end and small end, require strength with a high stress concentration coefficient. On the other hand, in an axle shaft, the surface layer of the part as a whole is twisted and surface layer of the part as a whole requires strength. In the present invention, the "locations where strength is required" shows the surface layer at these parts. By working and heat treating the surface layer at these locations where strength is required so as to give an equivalent strain of 1.5 to 5.0 at the forging temperature described in claims 4 and 5, a high strength and high proof strength ratio are given. With a strain of, by equivalent strain, less than 1.5, the effect of increasing the fineness of the crystal grains is not sufficiently obtained, so the lower limit is made 1.5 or more. Further, a strain of over 5.0 by equivalent strain is not suitable industrially.

Here, the "equivalent strain" shows the equivalent amount of the strain, given in the multiaxial stress state, in the single axis stress state and is found by the technique described in *Plastic Working as Understood From the Basics* (Corona, published Feb. 25, 2003, 5th printing), pages 60 to 63.

The forging temperature was limited to the relatively high temperature of 1000° C. to 800° C. because if forging by a temperature less than 800° C., the deformation resistance remarkably increases and the production of actual parts having complicated shapes places too great a load on the forging machine and tooling. Further, if forging by a temperature over 1000° C., the effect of increasing the fineness of the austenite grains by the work recrystallization cannot be sufficiently obtained. Therefore, the upper limit of the forging temperature is made 1000° C., while the lower limit is made 800° C.

Claim 4 was limited to cooling, after working, to 550° C. to 650° C. in temperature range by an average cooling rate of 10° C./sec to 150° C./sec because if cooling by less than 10° C./sec, the strain introduced at the time of forging is eliminated in the cooling process by recovery and the recrystallization phenomenon, the worked and recrystallized crystal grains become coarser, and the effect of increasing the fineness of the crystal grains is not sufficiently obtained. Cooling by over 150° C./sec is not suitable industrially.

Claim 4 was limited to cooling, before forging, to 400° C. or less by an average cooling rate of 0.5° C./sec to 150° C./sec, then raising the temperature to 800 to 1000° C. by an average heating rate of 1.0° C./sec or more and, further, claim 5 was limited, right after forging, to cooling to 400° C. or less by an average cooling rate of 0.5° C./sec to 150° C./sec, then raising the temperature to 800 to 1000° C. by an average heating rate of 1.0° C./sec or more, so as to make the austenite grains further finer. That is, the steel was cooled from the austenite single phase region to 400° C. or less to lower it to the ferrite-pearlite transformation point or less. After transformation, the steel was raised in temperature to 800 to 1000° C. to change the structure to fine austenite. If cooling down to 400° C. or less by an average cooling rate of less than 0.5° C./sec and, further, raising the temperature at 800 to 1000° C. by an average heating rate of less than 1.0° C./sec, a sufficient effect of increasing the fineness of the austenite grains cannot be obtained. From the viewpoint of the effect of increasing the fineness of the austenite grains, a faster cooling rate and heating rate are preferred. However, cooling by over 150° C./sec is not suitable industrially.

After working and heat treating the locations where strength is required, the part as a whole is air cooled or thermostatically treated in claim 4 or the part as a whole is air cooled in claim 5 so as to make the steel structure at a position at least 1.0 mm from the surface of all or part of the part ferrite and pearlite and/or cementite and at locations from the center of thickness of the part to at least ⅙ thickness ferrite and pearlite.

The present invention will be explained in detail below by examples. Note that these examples are for explaining the effects of the present invention and do not limit the scope of the present invention.

EXAMPLES

Example 1

From steels having the chemical ingredients shown in Table 1-1, forging use test pieces of diameter 50 mm×height 60 mm were cut out. These were forward extruded applying the methods of production shown in Table 1-2 or 1-3 to prepare test pieces strengthened at the surface layer by fine grains. The equivalent strain shown in Tables 1-2 and 1-3 was calculated as explained above. At the position at least 1.0 mm from the surface, the average cooling rate at the time of reverse transformation shown in Table 1-2 and Table 1-3 is the heating temperature or is the average cooling rate of the temperature range from the forging temperature to 400° C. Further, the average heating rate at the time of reverse transformation shown in Table 1-2 is the average heating rate of the temperature range from 400° C. to the forging temperature 800 to 1000° C. Furthermore, the average heating rate at the time of reverse transformation shown in Table 1-3 is the average heating rate from 400° C. to 800° C. The test pieces as whole were allowed to cool after the forging shown in Table 1-2 and after cooling down to 600° C. Further, the test pieces as a whole were allowed to cool after the reverse transformation shown in Table 1-3. When using the method of production 1 or 2 of the present invention for heat treatment, the ferrite crystal grain size, tensile strength, proof strength ratio, and structure of the surface layer 1.0 mm below the surface and the ferrite crystal grain size and structure of the inside at a position of ⅙ the diameter from the surface became as shown in Table 1-1. The average particle size of the ferrite crystal grain was calculated as explained above.

The structure was examined by an optical microscope or scanning electron microscope. F-P indicates a ferrite and a pearlite structure, F-P(C) indicates a ferrite and a pearlite and cementite structure, and F-P-B indicates a ferrite, pearlite, and bainite structure. The tensile characteristics were measured using a JIS No. 3 test piece.

As shown in Table 1-1, Invention Example Nos. 1-10 and 1-13 are cases where the method of production 2 of the present invention is applied whereby in each case the result was a structure of the surface layer of ferrite having a ferrite grain size of 4 μm or less and of pearlite and a structure of the inside of ferrite having a ferrite grain size of 15 μm or more and of pearlite and having a tensile strength 810 MPa or more high strength and a 0.78 or more high proof strength ratio. Further, Invention Example Nos. 1-1 to 1-9, 1-11, and 1-12 are cases where the method of production 1 of the present invention is applied whereby in each case the result was a structure of the surface layer of ferrite having a ferrite grain size of 3.2 μm or less and of pearlite and cementite and a structure of the inside of ferrite having a ferrite grain size of 15 μm or more and of pearlite and having a much higher 0.80 or more high proof strength ratio. Even with 0.10 mass % or less low Nb steel, when applying the method of production 1 of the present invention, it became clear that a fine grain structure having a high proof strength ratio was obtained. Comparative Example Nos. 1-14 and 1-17 to 19 are steels in which the essential elements of the present invention C, Si, S, Al, and Nb are excessively added or not contained in the required amounts. When applying the methods of production 1 or 2 of the present invention, the result is a structure of ferrite of a ferrite grain size of over 4 μm and pearlite and a lower proof strength compared with the invention material. Further, Comparative Example Nos. 1-15, 1-16, and 1-20 are steels to which Si, Mn, and P are excessively added or not contained in the required amounts. When applying the methods of production 1 or 2 of the present invention, the bainite precipitates and proof strength remarkably drops compared with the invention material.

TABLE 1-1

| No. | Steel | C | Nb | Si | Mn | P | S | N | Al | V | Forging method |
|---|---|---|---|---|---|---|---|---|---|---|---|
| 1-1 | A | 0.45 | 0.48 | 0.28 | 1.53 | 0.025 | 0.072 | 0.0212 | | | 1 |
| 1-2 | B | 0.08 | 0.38 | 0.37 | 1.15 | 0.011 | 0.047 | 0.0062 | | | 1 |
| 1-3 | C | 0.57 | 0.12 | 0.21 | 1.23 | 0.034 | 0.027 | 0.0104 | | | 1 |
| 1-4 | D | 0.52 | 0.56 | 0.48 | 1.27 | 0.018 | 0.037 | 0.0092 | | | 1 |
| 1-5 | E | 0.58 | 0.27 | 0.11 | 0.97 | 0.083 | 0.052 | 0.0124 | | | 1 |
| 1-6 | F | 0.49 | 0.51 | 1.47 | 1.45 | 0.006 | 0.003 | 0.0066 | | | 1 |
| 1-7 | G | 0.63 | 0.35 | 0.53 | 0.42 | 0.01 | 0.082 | 0.0007 | | | 1 |
| 1-8 | H | 0.61 | 0.51 | 0.23 | 1.98 | 0.025 | 0.068 | 0.0158 | | | 1 |
| 1-9 | I | 0.83 | 0.57 | 0.24 | 1.64 | 0.019 | 0.062 | 0.0075 | 0.026 | | 1 |
| 1-10 | J | 0.51 | 0.13 | 0.31 | 1.45 | 0.000 | 0.073 | 0.0114 | 0.042 | | 2 |
| 1-11 | K | 0.58 | 0.02 | 0.18 | 1.56 | 0.008 | 0.040 | 0.0106 | 0.035 | | 1 |
| 1-12 | L | 0.85 | 0.12 | 0.25 | 1.42 | 0.009 | 0.038 | 0.0122 | 0.038 | 0.46 | 1 |
| 1-13 | M | 0.55 | 0.11 | 0.36 | 1.04 | 0.021 | 0.065 | 0.0086 | | 0.23 | 2 |
| 1-14 | N | 0.72 | 0.02 | 0.18 | 1.38 | 0.027 | 0.053 | 0.0135 | | | 2 |
| 1-15 | O | 0.87 | 0.63 | 0.08 | 0.78 | 0.027 | 0.019 | 0.0154 | | | 2 |
| 1-16 | P | 0.52 | 0.31 | 0.31 | 2.04 | 0.044 | 0.025 | 0.0087 | | | 1 |
| 1-17 | Q | 0.56 | 0.29 | 0.41 | 1.42 | 0.032 | 0.032 | 0.0034 | 0.058 | | 1 |
| 1-18 | R | 0.63 | 0.42 | 1.55 | 1.27 | 0.005 | 0.17 | 0.0187 | 0.024 | | 2 |
| 1-19 | S | 0.52 | 0.003 | 0.33 | 1.23 | 0.011 | 0.044 | 0.0113 | 0.025 | | 2 |
| 1-20 | T | 0.58 | 0.47 | 0.52 | 0.36 | 0.12 | 0.019 | 0.0048 | | 0.09 | 1 |

| | Surface layer | | | | Inside | | |
|---|---|---|---|---|---|---|---|
| No. | Ferrite crystal grain size (μm) | Tensile strength (MPa) | Proof strength ratio | Structure | Ferrite crystal grain size (μm) | Structure | Class |
| 1-1 | 2.5 | 817 | 0.86 | F—P(C) | 28 | F—P | Inv. ex. |
| 1-2 | 2.9 | 808 | 0.80 | F—P(C) | 23 | F—P | Inv. ex. |
| 1-3 | 3.2 | 872 | 0.82 | F—P | 25 | F—P | Inv. ex. |
| 1-4 | 2.3 | 691 | 0.86 | F—P(C) | 30 | F—P | Inv. ex. |
| 1-5 | 2.8 | 854 | 0.81 | F—P | 24 | F—P | Inv. ex. |
| 1-6 | 2.1 | 927 | 0.91 | F—P(C) | 31 | F—P | Inv. ex. |
| 1-7 | 2.7 | 795 | 0.83 | F—P | 32 | F—P | Inv. ex. |
| 1-8 | 1.9 | 1073 | 0.87 | F—P(C) | 28 | F—P | Inv. ex. |
| 1-9 | 2.0 | 1068 | 0.89 | F—P(C) | 25 | F—P | Inv. ex. |
| 1-10 | 3.9 | 855 | 0.79 | F—P | 20 | F—P | Inv. ex. |
| 1-11 | 1.9 | 964 | 0.89 | F—P(C) | 26 | F—P | Inv. ex. |
| 1-12 | 2.0 | 1023 | 0.81 | F—P(C) | 26 | F—P | Inv. ex. |
| 1-13 | 3.7 | 810 | 0.78 | F—P | 23 | F—P | Inv. ex. |
| 1-14 | 4.2 | 1052 | 0.68 | F—P | 29 | F—P | Comp. ex. |
| 1-15 | 3.8 | 978 | 0.67 | F—P—B | 35 | F—P | Comp. ex. |
| 1-16 | 3.1 | 1022 | 0.64 | F—P—B | 20 | F—P | Comp. ex. |
| 1-17 | 4.3 | 725 | 0.75 | F—P | 30 | F—P | Comp. ex. |
| 1-18 | 4.8 | 883 | 0.70 | F—P | 25 | F—P | Comp. ex. |
| 1-19 | 5.2 | 835 | 0.65 | F—P | 25 | F—P | Comp. ex. |
| 1-20 | 2.5 | 833 | 0.66 | F—P—B | 32 | F—P | Comp. ex. |

*Underlined parts indicate conditions outside the range of the present invention.

TABLE 1-2

| Reverse transformation | | | | | Right after forging |
|---|---|---|---|---|---|
| Heating temperature (° C.) | Average cooling rate (° C./sec) | Average heating rate (° C./sec) | Forging temperature (° C.) | Equivalent strain | Average cooling rate (° C./sec) |
| 1250 | 1 | 20 | 900 | 1.8 | 50 |

TABLE 1-3

| | | | Reverse transformation | |
|---|---|---|---|---|
| Heating temperature (° C.) | Forging temperature (° C.) | Equivalent strain | Average cooling rate (° C./sec) | Average heating rate (° C./sec) |
| 1250 | 900 | 1.8 | 1 | 20 |

Example 2

In, Example 2 shows a comparison of the strength and machineability of test pieces to which the method of production of the present invention is applied for fine grain strengthening of the surface layer and test pieces strengthened as a whole by fine grain strengthening.

In this study, three types of steel shown in Table 2-1 were used. The method of production shown in Table 2-2 was applied for forward extrusion to prepare test pieces with surface layers strengthened by fine grain strengthening. The equivalent strain shown in Table 2-2 was calculated as explained above. At the position at least 1.0 mm from the surface, the average cooling rate at the time of reverse transformation shown in Table 2-2 is the average cooling rate of the temperature range from the heating temperature to 400° C., while the average heating rate at the time of reverse transformation is the average heating rate in the temperature range from 400° C. to 800° C. After forging, the test pieces as a whole were allowed to cool. 200 μm was cut from the surfaces, then friction welding was used to connect screw parts. The connected parts bulging out due to the friction welding were cut off to prepare JIS No. 1 Ono type rotating bending fatigue test pieces. The method of production shown in Table 2-3 was applied and upset forging was used to fabricate test pieces strengthened overall by fine grain strengthening as a comparison. The equivalent strain shown in Table 2-3 was calculated by the above. The pieces were forged, then allowed to cool. JIS No. 1 Ono type rotating bending fatigue test pieces were taken from the centers of the forged materials. The thus prepared test pieces were used to evaluate the endurance limit of the test pipes by the Ono type rotating bending test.

The average particle size of the ferrite crystal grain was calculated by the above. The tensile characteristics were measured using a JIS No. 3 test piece. The structure was examined by an optical microscope or scanning electron microscope. F-P shows a ferrite and pearlite structure, while F-P(C) shows a ferrite and a pearlite and cementite structure. The hardness was evaluated by the Vicker's hardness. Drilling tests were conducted under the cutting conditions shown in Table 2-4 to evaluate the machinabilities of the test pieces with surface layers strengthened by fine grain strengthening and test pieces strengthened by fine grain strengthening as a whole. At this time, as an evaluation parameter, the maximum cutting rate VL1000 for cutting down to a cumulative hole depth of 1000 mm in a drilling test was employed. The results are shown in Table 2-5 and FIG. 1.

The prepared test pieces had a ferrite crystal grain size, structure, and hardness of the surface layer at 1.0 mm below the surface and a ferrite crystal grain size, proof strength ratio, structure, and hardness of the inside at a position of ⅙ the diameter from the surface as shown in Table 2-5. Further, they had the hardness differences of the surface layers and insides as shown in Table 2-5.

FIG. 1 plots the endurance limit on the abscissa and the results of VL1000 on the ordinate for the invention examples (test pieces with surface layers strengthened by fine grain strengthening) and the comparative examples (test pieces strengthened as a whole by fine grain strengthening).

TABLE 2-1

| Steel | C | Nb | Si | Mn | P | S | N | Al | V | Class |
|---|---|---|---|---|---|---|---|---|---|---|
| A | 0.45 | 0.48 | 0.28 | 1.53 | 0.025 | 0.072 | 0.0212 | | | Inv. ex. |
| D | 0.52 | 0.58 | 0.48 | 1.27 | 0.018 | 0.037 | 0.0092 | | | Inv. ex. |
| K | 0.58 | 0.02 | 0.18 | 1.56 | 0.006 | 0.040 | 0.0105 | 0.035 | | Inv. ex. |

TABLE 2-2

| Reverse transformation | | | | | Right after forging |
|---|---|---|---|---|---|
| Heating temperature (° C.) | Average cooling rate (° C./sec) | Average heating rate (° C./sec) | Forging temperature (° C.) | Equivalent strain | Average cooling rate (° C./sec) |
| 1250 | 1 | 20 | 800 | 1.8 | 50 |

TABLE 2-3

| Heating temperature (° C.) | Forging temperature (° C.) | Equivalent strain | Right after forging Average cooling rate (° C./sec) |
|---|---|---|---|
| 1250 | 680 | 1.8 | 50 |

TABLE 2-4

| | | |
|---|---|---|
| Cutting conditions | Cutting rate | 1-80 m/min |
| | Feed | 0.1 mm/rev |
| | Cutting oil | Water soluble cutting oil |
| Drilling | Drill diameter | ϕ3 mm |
| | High speed drill | |
| | Amount of projection | 45 mm |
| Others | Hole depth | 6 mm |
| | Tool life | Up to breakage |

TABLE 2-5

| | | | Surface layer | | | | inside | | | | | | |
|---|---|---|---|---|---|---|---|---|---|---|---|---|---|
| No. | Steel | Forging method | Ferrite crystal grain size (μm) | Proof strength ratio | Structure | Hardness HV | Ferrite crystal grain size (μm) | Structure | Hardness HV | Hardness difference ΔHV | Endurance strength (MPa) | VL1000 (m/min) | Class |
| 2-1 | A | 1 | 1.3 | 0.90 | F—P(C) | 251 | 23 | F—P | 229 | 32 | 405 | 57 | Inv. ex. |
| 2-2 | D | 1 | 1.1 | 0.93 | F—P(C) | 329 | 32 | F—P | 276 | 53 | 510 | 33 | Inv. ex. |
| 2-3 | K | 1 | 0.98 | 0.86 | F—P(C) | 313 | 29 | F—P | 271 | 42 | 470 | 37 | Inv. ex. |
| 2-4 | A | 2 | 1.2 | 0.90 | F—P(C) | 268 | 1.4 | F—P(C) | 258 | 10 | 410 | 48 | Comp. ex. |
| 2-5 | D | 2 | 15 | 0.89 | F—P(C) | 333 | 1.7 | F—P(C) | 324 | 9 | 500 | 15 | Comp. ex. |
| 2-6 | K | 2 | 1.6 | 0.88 | F—P(C) | 318 | 1.8 | F—P(C) | 303 | 15 | 470 | 25 | Comp. ex. |

As will be understood from Table 2-5 and FIG. 1, it is shown that by strengthening the surface layer by fine grain strengthening, a strength equivalent to the test piece as a whole when reinforced was shown. Further, it was learned that despite the endurance strength being equal etc., the machinability of a test piece with a surface layer strengthened by fine grain strengthening is superior to that of a test piece obtained by strengthening the test piece as a whole.

Example 3

From steels having the chemical ingredients shown in Table 3-1, forging use test pieces of diameter 50 mm×height 60 mm were cut out. These were forward extruded applying the methods of production shown in Table 3-2 to prepare test pieces strengthened at the surface layer by fine grains. The equivalent strain shown in Table 3-2 was calculated by the above. The average cooling rate at the time of reverse transformation shown in Table 3-2 is the average cooling rate in the temperature range from the heating temperature to 400° C., while the average heating rate at the time of reverse transformation is the average heating rate in the temperature range from 400° C. to the forging temperature. Further, the average cooling rate right after forging shown in Table 3-2 is the average cooling rate in the temperature range from the forging temperature to 600° C. After forging, the test pieces were cooled down to 600° C., then were thermostatically treated at 600° C. for 2 minutes, then were allowed to cool as a whole. In Invention Example Nos. 3-12 and 3-24, the heat treatment for the reverse transformation is not performed. The steels are allowed to cool after forging.

When applying the method of production of the present invention shown in Table 3-2 for the heat treatment, the result became a ferrite crystal grain size, tensile strength, proof strength ratio, and structure of the surface layer 1.0 mm below the surface and a ferrite crystal grain size and structure of the inside at ⅙ of the diameter from the surface as shown in Table 3-2. The average particle size of the ferrite crystal grain was calculated as explained above. The structure was examined from the center of the forged part by an optical microscope or scanning electron microscope. F-P shows a ferrite-pearlite structure, F-P(C) shows a ferrite and a pearlite and cementite structure, and F-C shows a ferrite and cementite structure. The tensile characteristics were measured using JIS No. 3 test pieces.

As shown in Table 3-2, it is clear that Invention Example Nos. 3-1 to 6 and 3-13 to 18 all have structures comprised of ferrite having a ferrite grain size of 3.3 μm or less, pearlite, and cementite or structures comprised of ferrite and cementite structure at the surface layer, having structures comprised of ferrite having a ferrite grain size of 15 μm or more and pearlite at the inside, and having tensile strength 847 MPa or more high strengths and 0.79 or more high proof strength ratios. Comparative Example Nos. 3-7 and 3-19 have low heating temperatures before reverse transformation, small amounts of solute atoms of solid solution Nb, insufficient effects of increasing the fineness of the austenite due to solute drag, average particle sizes of structures of the surface layers after heat treatment of 4 μm or more, and low proof strengths. Comparative Example Nos. 3-8 and 3-20 have slow cooling rates and heating rates at the time of reverse transformation, insufficient effect of increase of fineness of the austenite grains due to the reverse transformation, average particle sizes of the surface layers after heat treatment of 4 μm or more, and low proof strengths. Comparative Example Nos. 3-9 and 3-21 have high forging temperatures, remarkable growth of recrystallization, and coarse structures after heat treatment. Comparative Example Nos. 3-10 and 3-22 have small degree of processings and small nucleation forming rates. Therefore, the effects of increasing the fineness are insufficient, the average particle sizes of the structures of the surface layers after heat treatment are 4 μm or more, and the proof strengths are low. Comparative Example Nos. 3-11 and 3-23 have slow cooling rates right after forging, grain growth due to recovery or the recrystallization phenomenon in the cooling process, and coarse structures after heat treatment. Comparative Examples 3-12 and 3-24 do not include heat treatment after reverse transformation, so the effects of increase of the fineness of the austenite grains cannot be obtained and the structures become coarse ones of ferrite having average particle sizes of the structures of the surface layers after heat treatment of 10 μm or more and pearlite.

TABLE 3-1

| Steel | C | Nb | Si | Mn | P | S | N | Al | V | Class |
|---|---|---|---|---|---|---|---|---|---|---|
| D | 0.52 | 0.58 | 0.48 | 1.27 | 0.018 | 0.037 | 0.0092 | | | Inv. ex. |
| K | 0.58 | 0.02 | 0.18 | 1.56 | 0.006 | 0.040 | 0.0105 | 0.035 | | Inv. ex. |

TABLE 3-2

| No. | Steel | Heating temperature (° C.) | Reverse transformation: Average cooling rate (° C./sec) | Reverse transformation: Average heating rate (° C./sec) | Forging temperature (° C.) | Equivalent strain | Right after forging: Average cooling rate (° C./sec) | Surface layer: Ferrite crystal grain size (μm) | Surface layer: Tensile strength (MPa) | Surface layer: Proof strength ratio | Surface layer: Structure | Inside: Ferrite crystal grain size (μm) | Inside: Structure | Class |
|---|---|---|---|---|---|---|---|---|---|---|---|---|---|---|
| 3-1 | D | 1200 | 1 | 20 | 900 | 1.8 | 50 | 1.9 | 869 | 0.89 | F—P(C) | 22 | F—P | Inv. ex. |
| 3-2 | | 1250 | 5 | 5 | 900 | 1.8 | 50 | 2.4 | 805 | 0.88 | F—P(C) | 17 | F—P | |
| 3-3 | | 1250 | 1 | 20 | 1000 | 1.7 | 50 | 2.6 | 847 | 0.81 | F—P(C) | 31 | F—P | |
| 3-4 | | 1250 | 1 | 20 | 900 | 1.8 | 50 | 0.82 | 1052 | 0.99 | F—C | 16 | F—P | |
| 3-5 | | 1250 | 1 | 20 | 900 | 1.6 | 50 | 2.8 | 885 | 0.01 | F—P(C) | 31 | F—P | |
| 3-6 | | 1250 | 1 | 20 | 900 | 1.8 | 15 | 3.3 | 886 | 0.78 | F—P(C) | 33 | F—P | |
| 3-7 | | 1100 | 1 | 20 | 900 | 1.8 | 50 | 4.2 | 832 | 0.70 | F—P | 33 | F—P | Comp. ex. |
| 3-8 | | 1250 | 0.2 | 0.5 | 900 | 1.8 | 50 | 4.8 | 864 | 0.89 | F—P | 18 | F—P | |
| 3-9 | | 1250 | 1 | 20 | 1100 | 1.6 | 50 | 6.8 | 784 | 0.88 | F—P | 29 | F—P | |
| 3-10 | | 1250 | 1 | 20 | 900 | 1.4 | 50 | 4.6 | 839 | 0.88 | F—P | 18 | F—P | |
| 3-11 | | 1250 | 1 | 20 | 900 | 1.8 | 0.5 | 8.0 | 807 | 0.72 | F—P | 31 | F—P | |
| 3-12 | | 1250 | No reverse transformation | | 900 | 1.8 | 50 | 12.5 | 886 | 0.62 | F—P | 25 | F—P | |
| 3-13 | K | 1200 | 1 | 20 | 900 | 1.8 | 50 | 1.8 | 985 | 0.90 | F—P(C) | 33 | F—P | Inv. ex. |
| 3-14 | | 1250 | 5 | 5 | 900 | 1.8 | 50 | 2.6 | 954 | 0.84 | F—P(C) | 34 | F—P | |
| 3-15 | | 1250 | 1 | 20 | 1000 | 1.7 | 50 | 2.5 | 871 | 0.83 | F—P(C) | 23 | F—P | |
| 3-16 | | 1250 | 1 | 20 | 900 | 1.8 | 50 | 0.92 | 1083 | 0.98 | F—C | 18 | F—P | |
| 3-17 | | 1250 | 1 | 20 | 900 | 1.6 | 50 | 3.1 | 922 | 0.78 | F—P(C) | 32 | F—P | |
| 3-18 | | 1250 | 1 | 20 | 900 | 1.8 | 15 | 3.3 | 896 | 0.79 | F—P(C) | 26 | F—P | |
| 3-19 | | 1100 | 1 | 20 | 900 | 1.8 | 50 | 4.6 | 906 | 0.68 | F—P | 33 | F—P | Comp. ex. |
| 3-20 | | 1250 | 0.2 | 0.5 | 900 | 1.8 | 50 | 5.0 | 967 | 0.68 | F—P | 18 | F—P | |
| 3-21 | | 1250 | 1 | 20 | 1100 | 1.6 | 50 | 7.5 | 870 | 0.68 | F—P | 28 | F—P | |
| 3-22 | | 1250 | 1 | 20 | 900 | 1.4 | 50 | 6.2 | 875 | 0.66 | F—P | 17 | F—P | |
| 3-23 | | 1250 | 1 | 20 | 900 | 1.8 | 0.5 | 5.7 | 912 | 0.67 | F—P | 32 | F—P | |
| 3-24 | | 1250 | No reverse transformation | | 900 | 1.8 | 50 | 15.4 | 823 | 0.60 | F—P | 25 | F—P | |

*Underlined parts indicate conditions outside the range of the present invention.

Example 4

From steels having the chemical ingredients shown in Table 4-1, forging use test pieces of diameter 50 mm×height 60 mm were cut out. These were forward extruded applying the methods of production shown in Table 4-2 to prepare test pieces strengthened at the surface layer by fine grains. The equivalent strain shown in Table 4-2 was calculated by the above. The average cooling rate at the time of reverse transformation shown in Table 4-2 is the average cooling rate of the temperature range from the forging temperature to 400° C., while the average heating rate at the time of reverse transformation is the average heating rate in the temperature range from 400° C. to 800° C. The test pieces as a whole were allowed to cool after reverse transformation. When applying the method of production of the present invention shown in Table 4-2 for heat treatment, the result became a ferrite crystal grain size, tensile strength, proof strength ratio, and structure of the surface layer at 1.0 mm below the surface and a ferrite crystal grain size and structure of the inside at a position of ⅙ of the diameter from the surface as shown in Table 4-2. The average particle size of the ferrite crystal grain was calculated as explained above. The structure was examined from the center of the forged part by an optical microscope or scanning electron microscope. F-P shows a ferrite-pearlite structure. The tensile characteristics were measured using a JIS No. 3 test piece.

As shown in Table 4-2, it becomes clear that Invention Example Nos. 4-1 to 5, 4-10 to 14, and 4-19 to 23 all have structures of the surface layers comprised of fine grain ferrite having a ferrite grain size of 4 μm or less and pearlite or structures comprised of ferrite and pearlite and cementite, have high strengths of tensile strengths of 810 MPa or more, and have 0.74 or more high proof strength ratios. Comparative Example Nos. 4-6, 4-15, and 4-24 have low heating temperatures before forging, small amounts of solute atoms of solid solution Nb, insufficient effects of increasing the fineness of austenite grains due to solute drag, insufficient effects of increasing the fineness of the structures of the surface layers after heat treatment, coarse structures, and low proof strengths. Comparative Example Nos. 4-7, 4-16, and 4-25 have high forging temperatures, remarkable growth of recrystallization, small effects of increasing the fineness of the structures by reverse transformation, and coarse structures of the surface layers after heat treatment. Comparative Example Nos. 4-8, 4-17, and 4-26 have small degree of processings, do not give sufficient effects of increasing the fineness, and have coarse structures of the surface layers after heat treatment. Comparative Example Nos. 4-9, 4-18, and 4-27 have slow cooling rates and heating rates at the time of reverse transformation, insufficient effects of increase of fineness of the austenite grains due to reverse transformation, coarse structures of the surface layers after heat treatment, and low proof strengths.

TABLE 4-1

| Steel | C | Nb | Si | Mn | P | S | N | Al | V | Class |
|---|---|---|---|---|---|---|---|---|---|---|
| C | 0.57 | 0.12 | 0.21 | 1.23 | 0.034 | 0.027 | 0.0104 | | | Inv. ex. |
| I | 0.63 | 0.57 | 0.24 | 1.64 | 0.019 | 0.062 | 0.0075 | 0.028 | | Inv. ex. |
| L | 0.65 | 0.12 | 0.25 | 1.42 | 0.009 | 0.035 | 0.0122 | 0.038 | 0.46 | Inv. ex. |

TABLE 4-2

| | | | | | Reverse transformation | | Surface layer | | | | Inside | | |
|---|---|---|---|---|---|---|---|---|---|---|---|---|---|
| No. | Steel | Heating temperature (° C.) | Forging temperature (° C.) | Equivalent strain | Average cooling rate (° C./sec) | Average heating rate (° C./sec) | Ferrite crystal grain size (μm) | Tensile strength (MPa) | Proof strength ratio | Structure | Ferrite crystal grain size (μm) | Structure | Class |
| 4-1 | C | 1200 | 900 | 1.8 | 1 | 20 | 3.0 | 867 | 0.79 | F—P(C) | 34 | F—P | Inv. ex. |
| 4-2 | | 1250 | 1000 | 1.7 | 1 | 20 | 3.7 | 810 | 0.75 | F—P | 28 | F—P | |
| 4-3 | | 1250 | 600 | 1.8 | 1 | 20 | 3.0 | 862 | 0.80 | F—P(C) | 22 | F—P | |
| 4-4 | | 1250 | 900 | 1.6 | 1 | 20 | 3.5 | 825 | 0.74 | F—P | 29 | F—P | |
| 4-5 | | 1250 | 900 | 1.8 | 5 | 5 | 3.9 | 810 | 0.74 | F—P | 29 | F—P | |
| 4-6 | | 1100 | 900 | 1.8 | 1 | 20 | 5.9 | 804 | 0.68 | F—P | 29 | F—P | Comp. ex. |
| 4-7 | | 1250 | 1100 | 1.8 | 1 | 20 | 8.7 | 821 | 0.69 | F—P | 26 | F—P | |
| 4-8 | | 1250 | 900 | 1.4 | 1 | 20 | 8.1 | 843 | 0.70 | F—P | 33 | F—P | |
| 4-9 | | 1250 | 900 | 1.6 | 0.2 | 0.5 | 9.8 | 824 | 0.64 | F—P | 31 | F—P | |
| 4-10 | I | 1200 | 900 | 1.9 | 1 | 20 | 3.2 | 1023 | 0.78 | F—P(C) | 27 | F—P | Inv. ex. |
| 4-11 | | 1250 | 1000 | 1.7 | 1 | 20 | 4.0 | 973 | 0.75 | F—P | 21 | F—P | |
| 4-12 | | 1250 | 600 | 1.9 | 1 | 20 | 2.6 | 1065 | 0.85 | F—P(C) | 28 | F—P | |
| 4-13 | | 1250 | 900 | 1.6 | 1 | 20 | 3.5 | 997 | 0.78 | F—P | 26 | F—P | |
| 4-14 | | 1250 | 900 | 1.8 | 5 | 5 | 3.8 | 967 | 0.74 | F—P | 30 | F—P | |
| 4-15 | | 1100 | 900 | 1.8 | 1 | 20 | 5.2 | 949 | 0.76 | F—P | 25 | F—P | Comp. ex. |
| 4-16 | | 1250 | 1100 | 1.6 | 1 | 20 | 7.9 | 1001 | 0.66 | F—P | 37 | F—P | |
| 4-17 | | 1250 | 900 | 1.4 | 1 | 20 | 5.4 | 971 | 0.74 | F—P | 31 | F—P | |
| 4-18 | | 1250 | 900 | 1.9 | 0.2 | 0.5 | 8.0 | 839 | 0.69 | F—P | 20 | F—P | |
| 4-19 | L | 1200 | 900 | 1.8 | 1 | 20 | 3.4 | 932 | 0.78 | F—P | 32 | F—P | Inv. ex. |
| 4-20 | | 1250 | 1000 | 1.7 | 1 | 20 | 3.8 | 965 | 0.76 | F—P | 22 | F—P | |
| 4-21 | | 1250 | 600 | 1.8 | 1 | 20 | 3.0 | 954 | 0.84 | F—P(C) | 30 | F—P | |
| 4-22 | | 1250 | 900 | 1.6 | 1 | 20 | 3.7 | 892 | 0.76 | F—P | 27 | F—P | |
| 4-23 | | 1250 | 900 | 1.8 | 5 | 5 | 4.0 | 864 | 0.74 | F—P | 24 | F—P | |
| 4-24 | | 1100 | 900 | 1.8 | 1 | 20 | 5.3 | 998 | 0.71 | F—P | 29 | F—P | Comp. ex. |
| 4-25 | | 1250 | 1100 | 1.6 | 1 | 20 | 8.2 | 874 | 0.64 | F—P | 34 | F—P | |
| 4-26 | | 1250 | 900 | 1.4 | 1 | 20 | 5.6 | 913 | 0.74 | F—P | 23 | F—P | |
| 4-27 | | 1250 | 900 | 1.9 | 0.2 | 0.5 | 9.3 | 850 | 0.66 | F—P | 22 | F—P | |

*Underlined parts indicate conditions outside the range of the present invention.

INDUSTRIAL APPLICABILITY

The part of the present invention is obtained by forging the surface layer at the locations where stress concentrates and strength is required at a practical temperature region and using the optimum steel and heat treatment to strengthen the structure by making it finer. The part as a whole is strengthened and the substantive part strength is raised without a remarkable drop in the machinability. The amounts of strengthening of these locations are remarkably larger compared with conventional hot forging use steel, so a high strength and high yield strength ratio part can be realized.

The invention claimed is:

1. A fine grain surface layer steel part containing, by mass %,

C: 0.45% to 0.70%,

Nb: 0.01% to 0.60%,

Si: 0.10% to 1.50%,

Mn: 0.40% to 2.0%,

P: 0.10% or less,

S: 0.001% to 0.15%,

N: 0.003% to 0.025% and having a balance of Fe and unavoidable impurities, said fine grain surface layer steel part characterized in that the surface layer and inside at all or part of the part have structures of different average particle sizes of ferrite crystal grains surrounded by high angle grain boundaries of a misorientation angle of 15 degrees or more, the structure from the surface to a depth of at least 1.0 mm is a structure comprised of ferrite having an average particle size of ferrite crystal grains surrounded by high angle grain boundaries of a misorientation angle of 15 degrees or more of 4 μm or less and of pearlite and/or cementite, while the structure of the location from the center of thickness of the part to at least ⅙ thickness is a structure comprised of ferrite having an average particle size of ferrite crystal grains surrounded by high angle grain boundaries of a misorientation angle of 15 degrees or more of 15 μm or more and of pearlite.

2. A fine grain surface layer steel part as set forth in claim 1, characterized in that the ingredients of the steel further contain, by mass %, Al: 0.005 to 0.050%.

3. A fine grain surface layer steel part as set forth in claim 1, characterized in that the ingredients of the steel further contain, by mass %, V: 0.01% to 0.50%.

4. A method of production of a fine grain surface layer steel part characterized by heating a steel material comprised of the ingredients as set forth in claim 1 at 1150° C. to 1350° C., cooling locations where strength is required to 400° C. or less by an average cooling rate of 0.5° C./sec to 150° C./sec, raising the temperature after said cooling to 800 to 1000° C. by an average heating rate of 1.0° C./sec or more, and warm forging to a predetermined shape at 1000° C. to 800° C. during which working to give an equivalent strain of 1.5 to 5.0, cooling after that working to 550° C. to 650° C. in temperature range by an average cooling rate of 10° C./sec to 150° C./sec, then air cooling or thermostatically treating the entire part so as to make the structure from the surface to a depth of at least 1.0 mm at locations where strength is required a structure comprised of ferrite having an average particle size of ferrite crystal grains surrounded by high angle grain boundaries of a misorientation angle of 15 degrees or more of 4 μm or less and of pearlite and/or cementite and make the structure of the location from the center of thickness of the part to at least ⅙ thickness a structure comprised of ferrite having an average particle size of ferrite crystal grains surrounded by high angle grain boundaries of a misorientation angle of 15 degrees or more of 15 μm or more and of pearlite.

5. A method of production of a fine grain surface layer steel part characterized by heating a steel material comprised of the ingredients as set forth in claim 1 at 1150° C. to 1350° C. and warm forging to a predetermined shape at 1000° C. to 800° C. during which working to give an equivalent strain of 1.5 to 5.0, cooling after that working to 400° C. or less by an average cooling rate of 0.5° C./sec to 150° C./sec, raising the temperature after said cooling to 800 to 1000° C. by an average heating rate 1.0° C./sec or more, then air cooling the entire part so as to make the structure from the surface to a depth of at least 1.0 mm at locations where strength is required a structure comprised of ferrite having an average particle size of ferrite crystal grains surrounded by high angle grain boundaries of a misorientation angle of 15 degrees or more of 4 μm or less and of pearlite and/or cementite and make the structure of the location from the center of thickness of the part to at least ⅙ thickness a structure comprised of ferrite having an average particle size of ferrite crystal grains surrounded by high angle grain boundaries of a misorientation angle of 15 degrees or more of 15 μm or more and of pearlite.

* * * * *